United States Patent [19]

Trame

[11] Patent Number: 4,970,816

[45] Date of Patent: Nov. 20, 1990

[54] ROOF SIGN

[75] Inventor: Charles E. Trame, Mequon, Wis.

[73] Assignee: Everbrite Electric Signs, Inc., Greenfield, Wis.

[21] Appl. No.: 463,595

[22] Filed: Jan. 11, 1990

[51] Int. Cl.[5] ..... G09F 13/04

[52] U.S. Cl. ..... 40/552; 40/540; 40/574

[58] Field of Search ..... 40/552, 558, 564, 574, 40/540

[56] References Cited

U.S. PATENT DOCUMENTS

| | | | |
|---|---|---|---|
| 4,077,146 | 3/1978 | Nasgowitz | 40/540 |
| 4,088,881 | 5/1978 | Neer et al. | 40/574 |

FOREIGN PATENT DOCUMENTS

| | | | |
|---|---|---|---|
| 577194 | 5/1958 | Italy | 40/552 |
| 627255 | 10/1961 | Italy | 40/552 |

*Primary Examiner*—Kenneth J. Dorner

*Assistant Examiner*—Cassandra L. Hope

*Attorney, Agent, or Firm*—Fuller, Ryan & Hohenfeldt

[57] ABSTRACT

An illuminated sign is comprised of single piece molded plastic front, intermediate and rear frame members which are substantially coextensive with the width of the sign. All of the characters are formed on the intermediate frame member and they fit into a front frame which serves not only as a support but as a means for masking those parts of the intermediate frame which connect between characters, for example, and which should not be illuminated. The sign is hingedly mounted to a fixed support member which, in turn, supports fluorescent tubes which run along the length of the sign for illuminating the characters to make them visible at night as well as during the daytime. The sign swings down on its hinges to its normal readable position wherein it is secured to the support member by means of quarter-turn fasteners which effectuate a seal for compressing a gasket which is interposed between the sign and the supporting structure.

9 Claims, 4 Drawing Sheets

20
40
39
10
57
55
25
34
41

65
74
43
73
77
29
70
68
47
69
76
64
71
75
67
27
72
63
76
28
66
77
56
80
58
60
45
59
61
35
62

ROOF SIGN

BACKGROUND OF THE INVENTION

The invention pertains to a sign which is characterized as being readable from a great distance, thereby making it ideal for mounting on the roof of a building.

SUMMARY OF THE INVENTION

Basically, the new sign features three molded frames which are arranged adjacent each other with parts of one of the frames inset in the others and with the parts bonded together with adhesive to form a unitary structure. The three frames, when assembled, have a long rear opening The assembly is mounted hingedly to a stationary base plate such that when the assembly is disposed in its normal vertical viewing position, a seal is effected between the assembly and the base plate The assembly can be swung on the hinges to a substantially horizontal position, thus making the fluorescent tubes which illuminate the sign and other components accessible for maintenance such as replacement of the fluorescent tubes. The base plate also provides a raceway for accommodating electrical wiring for energizing the ballasts for the fluorescent tubes. In the preferred embodiment, the three frames are each continuous over the entire length of the sign. The central one of the three frames has the alpha-numeric characters formed on it and these characters are translucent so they can be visualized at night when the fluorescent tubes are illuminated. The continuous one-piece front frame not only provides support for the assembly, but it is made of an opaque plastic so that parts of characters or parts of the frame which link between characters will be masked out. Signs of this type as long as 20 feet have been made.

A more detailed description of the structure of the new sign will now be set forth in reference to the following drawings.

DESCRIPTION OF A PREFERRED EMBODIMENT

Figure 1:
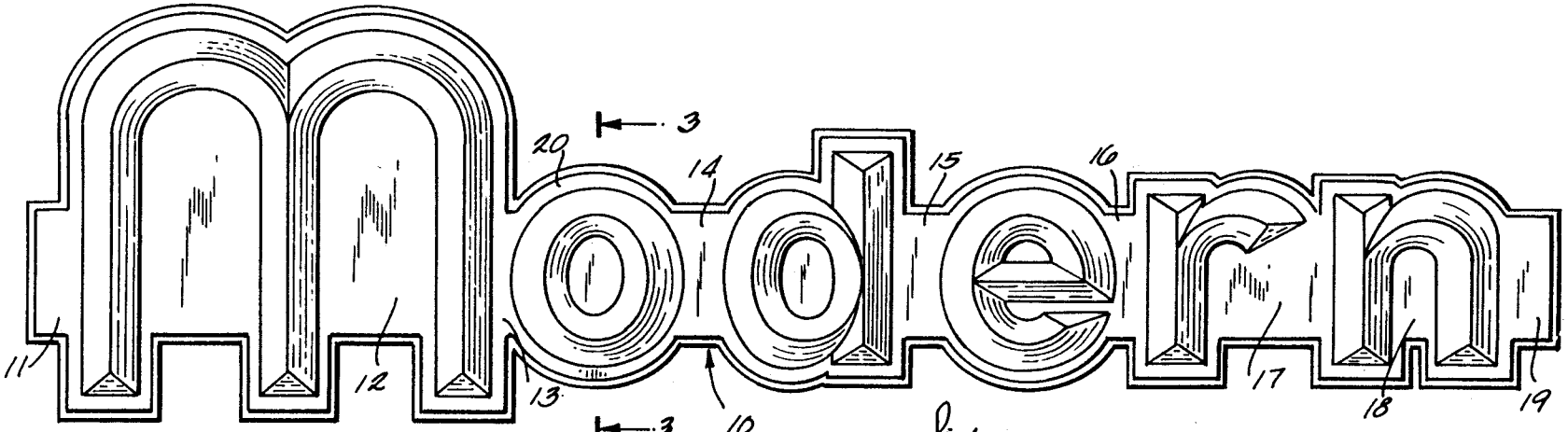
FIG. 1 is a front elevational view of a roof sign from which the roof mounting hardware has been omitted.

In FIG. 1 a front plate is generally designated by the reference numeral 10. It is composed of opaque plastic material which serves as a mask for darkening the spaces between letters in the sign so as to provide contrast with the illuminated letters. Areas 11–19 of the front frame 10 are flat in this design. The front frame 10 has suitable openings for allowing characters, such as the letters comprising the word "Modern", for example, to nest in the openings in the front frame. As will be described in more detail momentarily, the letters are formed on an intermediate frame member which is continuous from end to end of the sign. The letters, numerals or other characters composing the sign and the entire character frame are formed as a single molded piece. Further in reference to FIG. 1, it will be observed that the front frame 10 has margins around the letters, such as the margin marked 20, which are opaque and provide a surface with which the intermediate or character frame member interfaces in sealing relation as will be explained further subsequently.

Figure 2:
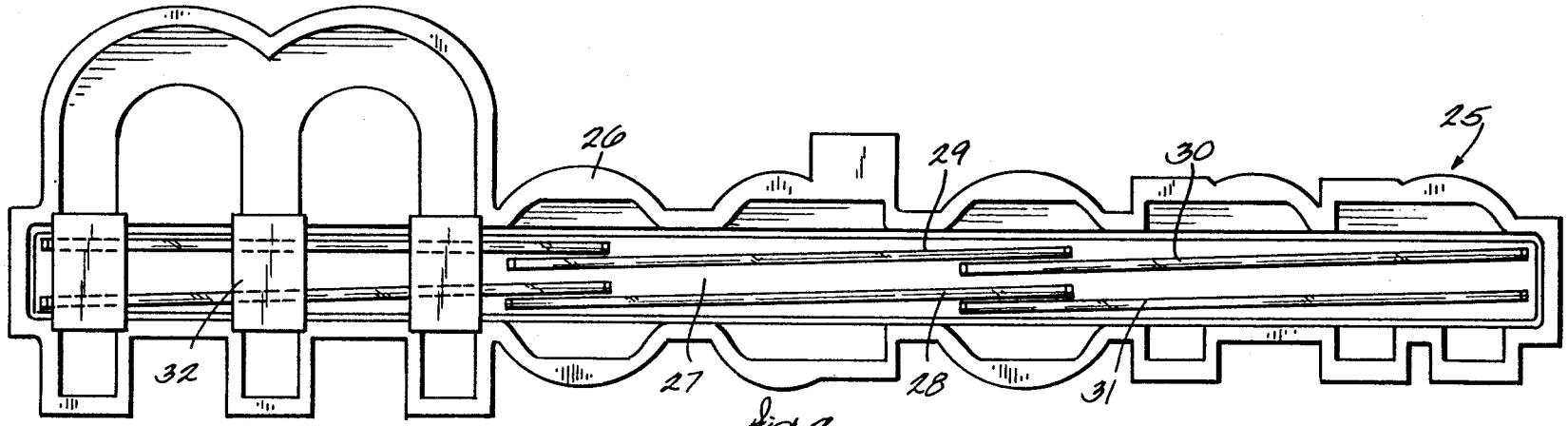
FIG. 2 is a view of the sign with the front frame omitted to show the front of the rear frame and the rectangular fluorescent tube supporting base plate of the sign.

In FIG. 2, the front frame 10 and the intermediate or character frame have been omitted to reveal the rear frame of the sign which is generally designated by the reference numeral 25. Rear frame 25 is molded of plastic as an uninterrupted or one piece member for the entire sign. The side facing the observer in FIG. 2 is preferably a white reflective surface. The rear frame 25 has flat marginal surfaces or rims such as the one marked 26 which are secured with adhesive to similar flat surfaces or rims surrounding the characters of the character frame which is not readily apparent in FIG. 2 but will be explained further in reference to other figures.

In FIG. 2 a base plate 27 extending over the length of the sign is visible. This plate has fluorescent tubes mounted on it, and it is preferably reflective. In this illustrative embodiment there are three pairs of fluorescent tubes extending over the length of the sign. Typically, these tubes may each be 8 feet long. For the sake of getting uniform illumination, the ends of tubes 28 and 29 may overlap the ends of tubes 30 and 31. To provide for overlapping the ends of the fluorescent tubes, they are mounted on base plate 27 slightly inclined from horizontal. Filter plates such as the one marked 32 in FIG. 2 may be positioned over the fluorescent tubes at certain places to reduce the light intensity where the fluorescent tubes cross over parts of a character so the character is illuminated uniformly everywhere. Since the interior or front of rear plate 25 and the facing interior of the front plate 10 are each very glossy and reflective, the light emitted from the fluorescent tubes reflects back and forth from surface to surface inside of the sign to bring about uniform illumination of all of the characters.

Figures 7, 8:
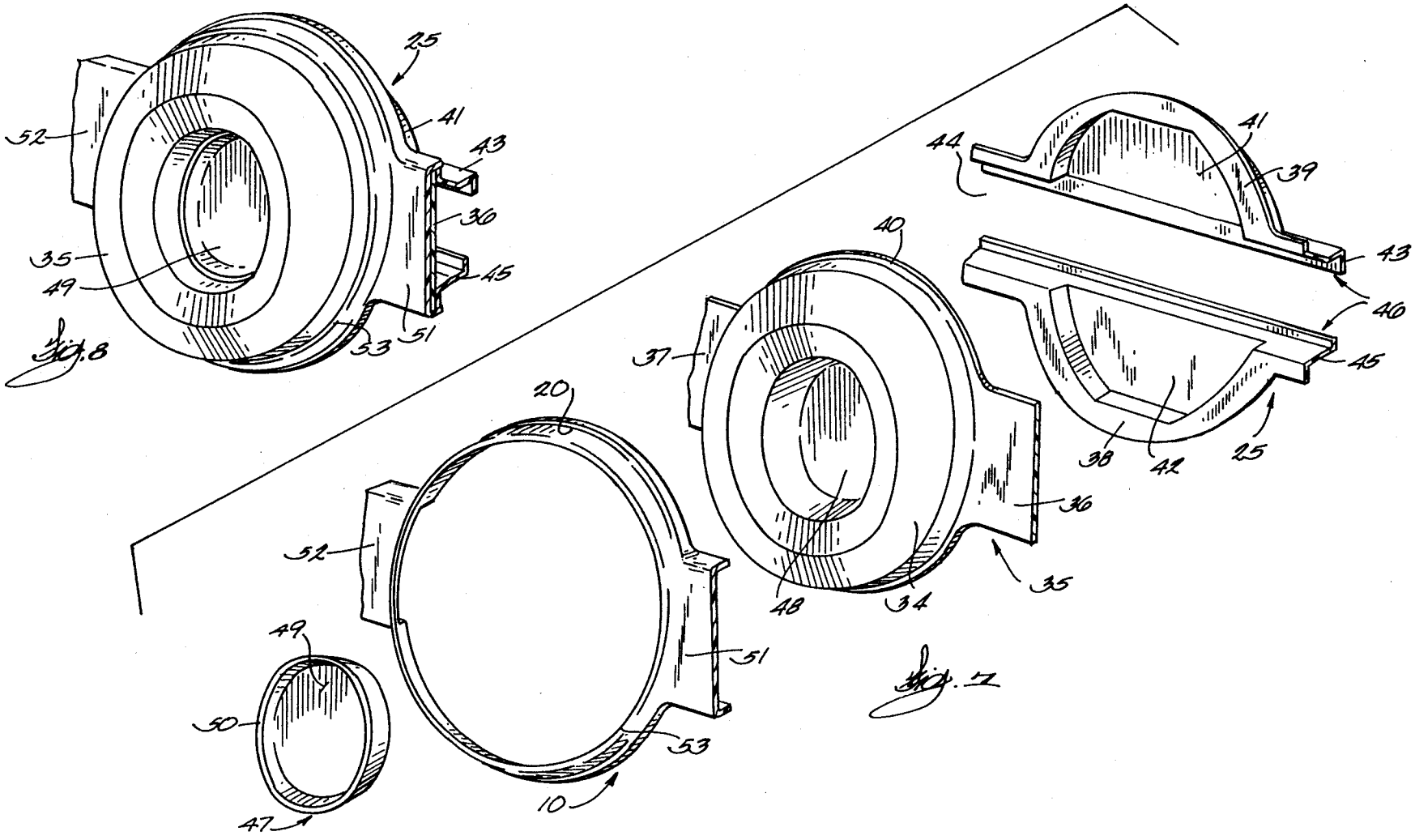
FIG. 7 is an exploded view of those parts of three long continuous molded plastic frames which are involved in forming one of the characters, particularly the letter "o" in the sign.
FIG. 8 shows the parts depicted in FIG. 7 in assembled condition.

Attention is now invited to FIG. 7 which shows an exploded view of the sign assembly in the vicinity of the letter "o" in the word "Modern" composing the sign in FIG. 1. FIG. 7 provides for visualizing the intermediate frame, which is designated generally by the reference numeral 35 and which is the character mounting frame. All of the letters, numerals or other artwork in the sign are formed on the character frame 35 as a single piece without interruptions between the characters over the entire length of the sign. The characters themselves are three dimensional, that is, they are in high relief and might be described as being deep drawn or highly embossed so they protrude toward the observer of the front of the sign and have a cavity on the opposite side Part of the character "o" in FIG. 7 is flat where it is marked 36 and this particular flat part would connect with a corresponding flat part on the adjacent letter "d" in the illustrative sign depicted in FIG. 1 to link the characters together The other flat portion 37 on the letter "o" would link to a corresponding portion of that part of the intermediate or character frame 35 on which the letter "M" is formed.

In FIG. 7 only that part of the rear frame 25 which resides in the vicinity of where the letter "o" is formed is depicted. The rear frame has flange portions, such as those marked 38 and 39 which interface with a rim 40 on the letter "o" so as to bring the rim into contact with the rim 20 on the front frame 10 when the sign is assembled. The flanges and rim have an adhesive bonding them together. The rear frame in the vicinity of the letter "o" in FIG. 7 is closed by means of an integral wall of plastic 41 on the top half and another similar wall of plastic 42 on the bottom half so that the sign is waterproof when it is assembled. Surfaces 41 and 42 are white and smooth and reflective plastic surfaces. There is an angle bar 43 molded integrally with flanges 38 and 39 and enclosure walls 41 and 42 of the back frame. If the letter "o" were at the end of the sign, one end of the rear frame such as the end marked 44 would be blocked off or closed by a wall, not shown, which would be molded integrally with the parts of the rear frame 25 depicted in FIG. 7. There is a Z-shaped member 45 molded integrally with the flange 38 and enclosure wall 42 of the back frame 25. The vertical space 46 between members 43 and 45 is ordinarily closed off by the plate 27 on which the fluorescent tubes are mounted when the sign is completely assembled.

The plastic letter "o" in FIG. 7 and all other characters formed on the character frame 35 are translucent and may be white or any other color. An insert 47 is provided in FIG. 7 to block out or darken the central region 48 of the letter "o" so only the circular part of the letter will transmit light. The insert 47 is, of course, molded of an opaque plastic material which has a flat region 49 for blocking light and a rim 50 for nesting it in the part of the rear frame 35 containing the letter "o". Note in FIG. 7 that the front frame 10 has side portions such as those marked 51 and 52 which are integral with corresponding portions extending from the characters on either side of a character such as the illustrative "o".

FIG. 8 shows the portion of the sign defining a letter "o" assembled. Note that the character frame 35 portion defining the letter "o" nests within the rim 53 of front frame 10. In the actual construction, these parts are bonded together with an adhesive. The rear frame 25 flanges 39 nest within the rim 40 of the letter "o" in the character frame.

Figure 3:
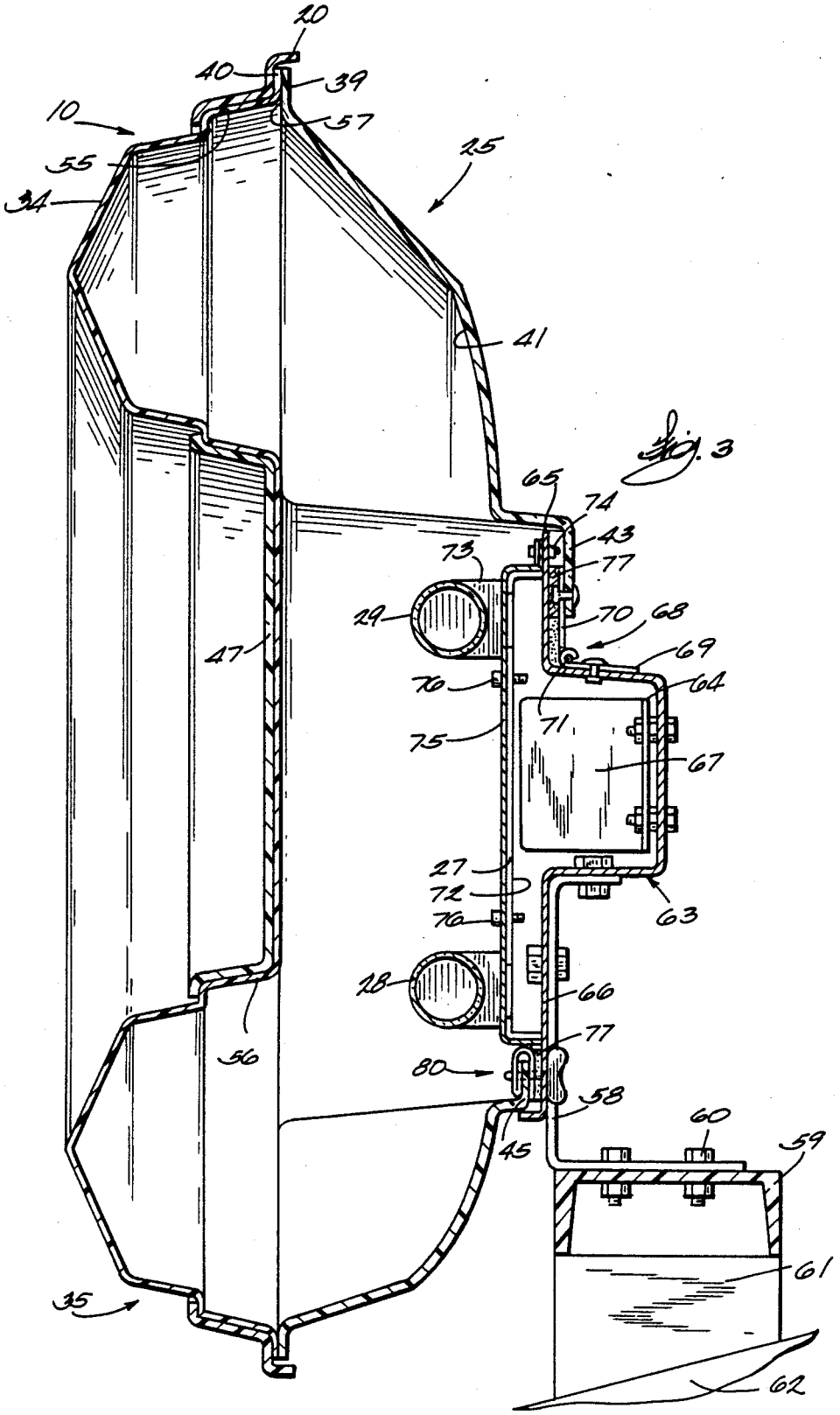
FIG. 3 is a vertical section taken through a character on a line corresponding to 3-3 in FIG. 1 wherein the frames of the sign are in their normal operating position.

Attention is now invited to FIG. 3 which shows a cross-section through the letter "o" and the structure behind it. This is typical of sections through other of the characters which are formed by nesting the parts of a character which are on the front frame 10, the intermediate or character frame 35 and the rear frame 25.

FIG. 3 shows the annular part 34 of the letter "0" in section. As previously mentioned, this part is composed of a translucent plastic and is molded along with other characters which compose the single piece character frame 35 which extends over the entire length of the sign. The frame 10 is somewhat like a ring having a previously mentioned rim 20 which is adhered with a layer of adhesive at the interface 55 to the annular outer part of the letter 34. The opaque blanking insert 47 for the center of the letter "o" is also in place and held there by adhesive deposited in the interface 56 between insert 47 and the translucent part 34 of the letter "o" which is formed on the character frame 35. There is also adhesive at the interface 57 of the flange or rim 40 on the letter 34 and a flange 39 on the rear frame 25.

Note in FIG. 3 that the sign is supported on a bracket 58 which is in turn mounted on a fixed structural member such as channel 59 and secured with bolts 60. The channel is part of a stand 61 which is mounted to the roof 62 of a building. The brackets 58 may be spaced along the structural member 59.

The sign is comprised of a supporting member 63 which is offset to form a channel 64. Supporting member 63 has an upwardly extending flange or flat portion 65 and a downwardly extending flange or flat portion 66. Member 63 is substantially coextensive with the length of the sign. Channel 64 provides a space for the ballasts, such as the one marked 67 which supply power to the fluorescent tubes such as those marked 28 and 29. Channel 64 also provides a raceway for running wires between the ballast 67 and the fluorescent tubes.

Figure 4:
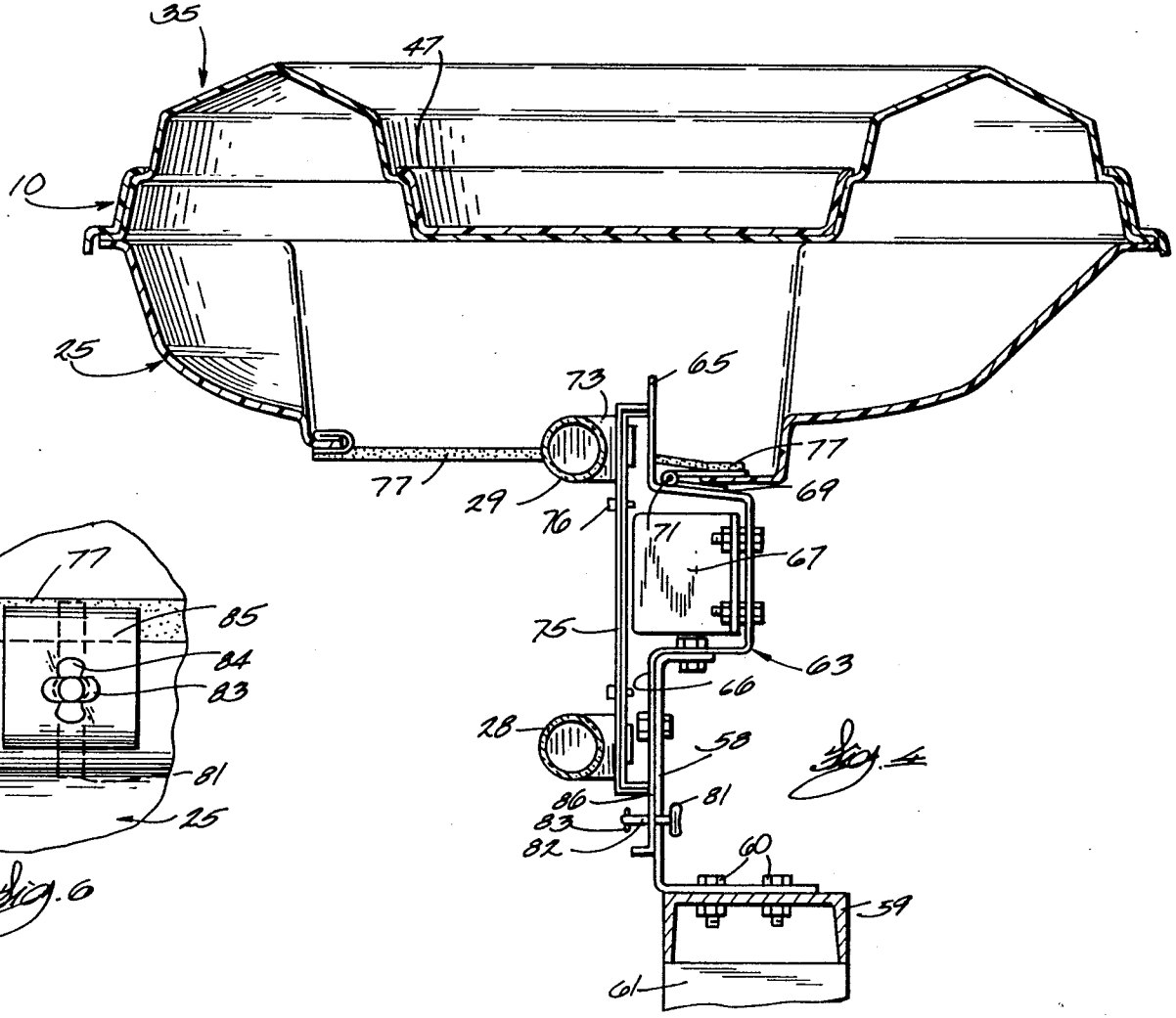
FIG. 4 is comparable to FIG. 3 except that the sign is swung on its hinges to a horizontal position for exposing the base plate which carries the fluorescent tubes which illuminate the sign.

Note further in FIG. 3 that a typical one of several hinges 68 appears in cross-section. There are several hinges spaced periodically along the length of the sign. One wing 69 of the hinge is bolted or otherwise fastened to the top of supporting member 63 and the other wing 70 of the hinge 68 is fastened to the rim 43 which is formed on rear frame 25. The hinge pin for hinge 68 is marked 71. There are channel-shaped brackets 72 mounted periodically along the length of the sign and interiorly thereof. The fluorescent tube sockets 73 may be mounted to these brackets. The brackets are bolted, such as by means of bolts 74, to the upwardly extending and downwardly extending flanges 65 and 66 of support member 63. A highly reflective sheet 75 of aluminum is mounted to these brackets by means of sheet metal screws 76 for enhancing distribution of the light within the cavities of characters which compose the readable sign. As has been noted, the back member 25 fastens to one wing 70 of a hinge whose other wing 69 is fixed on support member 63. This is to provide for swinging the entire assembled sign to a horizontal position as illustrated in FIG. 4. By doing this, the fluorescent tubes, such as those marked 28 and 29 become exposed for convenient replacement which must be done periodically. As is evident in FIGS. 3 and 4, there is a continuous gasket 77 adhered to the back frame member. In FIG. 3, the gasket is interfacing with and in sealing relation with upper flange 65 an lower flange 66 of supporting member 63. In FIG. 4 one may see that the upper run of the gasket 77 is spaced away from upwardly extending flange 65 and the lower end of the gasket is spaced away from the flat vertical surface 66 on the supporting member 63.

Figure 6:
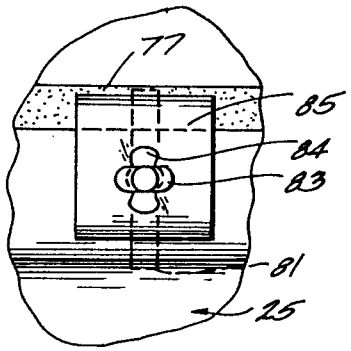
FIG. 6 is a front elevational view of the latch as seen looking in the direction of the arrows 6—6 in FIG. 5.
Figure 5:
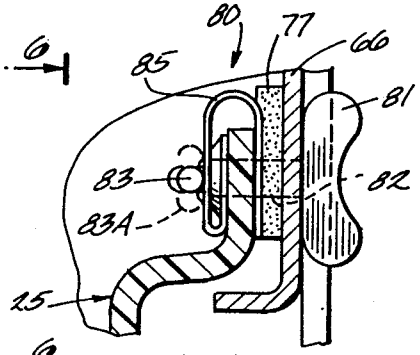
FIG. 5 is a cross-section of one of the latches or clamps which clamps the open rear of the sign assembly in compressive relation to the base plate to effect a water proof seal when the sign is in its normal operating position as is the case in FIGS. 1 and 3.

When the sign is rocked to its viewable position as in FIG. 3, it is desirable to clamp it to compress the gasket 77 and thereby prevent atmospheric contaminants from entering the interior of the sign. A plurality of quarter-turn fasteners, generally designated by the reference numeral 80 are arranged along the length of the sign. A section of a typical fastener is depicted in FIG. 5. It is a commercially available item. The fastener comprises a finger engageable wing 81 which is fixed on one end of a shank 82. The other end 83 of the shank is formed as a short cross member or key which is shown in solid lines in FIG. 5 in its locked position and in dashed lines 83A when it is rotated a quarter-turn. The back side view of the key or cross member 83 is shown rotated to its locked position as is the case in FIG. 5. In FIG. 6, one may see that the cross member of key 83 will fit through a key hole 84 in a reentrantly formed flat spring member 85. To lock the sign against tilting, the key portion 83 is inserted through the key hole 84 and turned a quarter of a turn to effect locking under a spring biasing force which assists in applying clamping pressure onto gasket 77.

In summary, a roof sign is provided which is comprised of three nested and bonded together adjacent frames which run the length of the sign. There is a front frame and a rear frame and a character frame between them. The intermediate or character frame which, like the front and rear frames, is formed as a single piece on which a series of characters are formed in high relief. The assembly constituting the nested front, intermediate and rear frames is hingedly mounted to a supporting member. The supporting member supports the fluorescent tubes for illuminating the characters of the signs The frames are formed by molding them in great single lengths. The whole sign composed of the united frames can be swung on hinges to make its interior accessible, particularly the fluorescent tubes which are fixedly mounted to the support for the sign.

Although a preferred embodiment of the sign has been described in substantial detail, such description is intended to be illustrated rather than limiting, for the invention may be variously embodied and is to be limited only by interpreting the claims that follow.

I claim:

1. A sign comprising:

an elongated molded single piece of plastic material constituting a rigid character frame in which a sequence of hollow light transmissive frontwardly extending characters are formed in high relief and there are substantially planar linking parts of the frame extending from one character to the next which contain no part of a character but join the characters to form said single piece, said characters having rear openings and having planar rim portions around the rear openings, the rim portions merging with and being coplanar with said planar linking parts of the frame which extend from one character to the next, an elongated molded single piece of plastic material constituting a rigid rear frame, said rear frame having planar rim portions and contiguous planar parts for bonding by means of an adhesive withsaid rim portions and planar parts, respectively, on the character frame, said rear frame having rearwardly positioned rims constituting the margins of an elongated rear opening which is substantially coextensive with the length of the rear frame and elongated character frame, fixedly mounted support means having flat surfaces coextensive with said opening in the rear frame, and hinge means coupling said rear frame to said support means for enabling said bonded together rear frame and character frame to be swung from a position wherein said rims or the rear frame and said flat surfaces on said support means interface to close said opening in the rear frame to a position away from the support means to provide access to the support means.

2. The sign according to claim 1 including light sources mounted to said support means.

3. The sign according to claim 1 including a plurality of light sources constituted by fluorescent tubes arranged along said support means coextensive with the length of the support means.

4. The sign according to claim 1 including resilient sealing means interposed between said rims constituting the margins of said opening in the rear frame and said flat surfaces on the support means.

5. The sign according to claim 4 including fastener means for urging said rear frame toward said fixed support means to compress said sealing means.

6. The sign according to claim 1 including walls on said rear frame on opposite ends of said rear frame for closing the ends of said rear opening.

7. The sign according to claim 1 wherein one side of said rear frame which faces toward said character frame is reflective.

8. The sign according to claim 1 including opaque masking means covering areas on said character frame other than the characters themselves.

9. The sign according to claim 1 including a molded single piece of plastic material substantially coextensive in length with said character and rear frames constituting a front frame, said front frame having openings corresponding to each character and through which said high relief characters, respectively project, the plastic material of the front frame being opaque for masking areas on said character frame contiguous with said characters, said front frame being adhered to said character frame.

* * * * *

UNITED STATES PATENT AND TRADEMARK OFFICE

CERTIFICATE OF CORRECTION

PATENT NO. : 4,970,816

DATED : November 20, 1990

INVENTOR(S) : Charles E. Trame

It is certified that error appears in the above—identified patent and that said Letters Patent is hereby corrected as shown below:

Column 5, Claim 1, Line 51:
Delete "withsaid" and substitute --- said ---.

Column 6, Claim 1, Line 13:
Delete "or" and substitute --- of ---.

Signed and Sealed this

Sixteenth Day of June, 1992

*Attest:*

DOUGLAS B. COMER

*Attesting Officer*

*Acting Commissioner of Patents and Trademarks*